US008387408B2

(12) United States Patent
Kim et al.

(10) Patent No.: US 8,387,408 B2
(45) Date of Patent: Mar. 5, 2013

(54) ICE DISPENSING APPARATUS AND REFRIGERATOR

(75) Inventors: Seong Jae Kim, Ansan-si (KR); Chang Ho Seo, Jinju-si (KR); Nam Gi Lee, Pohang-si (KR)

(73) Assignee: LG Electronics Inc., Seoul (KR)

( * ) Notice: Subject to any disclaimer, the term of this patent is extended or adjusted under 35 U.S.C. 154(b) by 658 days.

(21) Appl. No.: 11/966,328

(22) Filed: Dec. 28, 2007

(65) Prior Publication Data

US 2008/0156826 A1 Jul. 3, 2008

(30) Foreign Application Priority Data

Dec. 28, 2006 (KR) ..... 10-2006-0136309

(51) Int. Cl.
*F25C 1/22* (2006.01)
*F25C 5/18* (2006.01)
*F25C 5/02* (2006.01)

(52) U.S. Cl. ..... 62/340; 62/320; 62/344

(58) Field of Classification Search ..... 62/340, 62/344, 320; 241/DIG. 17
See application file for complete search history.

(56) References Cited

U.S. PATENT DOCUMENTS

| | | | | |
|---|---|---|---|---|
| 3,348,656 | A * | 10/1967 | Hall et al. | 198/550.1 |
| 6,442,954 | B1 * | 9/2002 | Shapiro et al. | 62/137 |
| 2005/0262866 | A1 * | 12/2005 | Seo et al. | 62/340 |
| 2006/0059939 | A1 * | 3/2006 | An et al. | 62/344 |
| 2006/0202071 | A1 * | 9/2006 | Jung et al. | 241/34 |

FOREIGN PATENT DOCUMENTS

KR 10-2006-0027146 A 3/2006

OTHER PUBLICATIONS

Korean Office Action dated Oct. 23, 2007 for Application No. 10-2006-0136309, with English Translation, 7 pages.

* cited by examiner

*Primary Examiner* — Frantz Jules
*Assistant Examiner* — Cassey D Bauer
(74) *Attorney, Agent, or Firm* — Fish & Richardson P.C.

(57) ABSTRACT

An ice dispensing apparatus and a refrigerator having the ice dispensing apparatus are provided. The ice dispensing apparatus includes a case provided with an ice inlet and an ice outlet, a conveying unit that is provided on a first side of the case to convey and discharge ice cubes through the ice outlet, an ice-crushing unit that is provided on a second side of the case to crush the ice cubes into ice pieces and discharge the crushed ice pieces through the ice outlet, and an ice delivery unit for delivering the ice cubes input through an input portion to the conveying unit or the ice-crushing unit.

18 Claims, 5 Drawing Sheets

ICE DISPENSING APPARATUS AND REFRIGERATOR

BACKGROUND

The present disclosure relates to an ice dispensing apparatus and a refrigerator. More particularly, the present disclosure relates to an ice dispensing apparatus that can stably dispense ice by employing an inventive ice conveying method, thereby improving ice dispensing reliability and thus reliability.

Generally, a refrigerator functions to store food at a low temperature by supplying cool air into refrigerant and freezing compartments using a cooling cycle apparatus having a compressor, a heat exchanger, and the like.

The refrigerator further has a function for making ice cubes by supplying cool air having a temperature below zero to the freezing compartment and dispensing the ice cubes or crushed ice pieces formed by crushing the ice cubes.

In order to properly make and dispense the ice cubes (or crushed ice pieces), an ice making apparatus and an ice dispensing apparatus are provided in the refrigerator. The ice making apparatus functions to make the ice cubes using the cool air of the freezing compartment and the ice dispensing apparatus functions to selectively dispense the ice cubes made by the ice making apparatus or the ice pieces formed by crushing the ice cubes.

The present disclosure is particularly related to the ice dispensing apparatus. A typical ice dispensing apparatus is designed to store the ice cubes made by the ice making apparatus and dispense the ice cubes by simply conveying the ice cubes when a user request the ice cubes. When the user requests the crushed ice pieces, the dispensing apparatus crushes the ice cubes and dispenses the ice pieces to the user.

However, since an amount of the ice cubes (or ice pieces) that is dispensed is not uniform, a large amount of the ice cubes is dispensed at a time. Further, when the ice cubes are conveyed by the conveying unit, an amount of the ice cubes conveyed by the conveying unit is not uniform. Therefore, when a large amount of the ice cubes are conveyed at a time, a bottleneck phenomenon occurs at a ice outlet side. This may cause a malfunction of the ice-crushing unit and a driving unit of the ice dispensing apparatus.

Further, since the ice cubes and the ice pieces are dispensed through a common dispensing path, the ice pieces remained in the ice-crushing unit may obstruct the dispensing of the ice cubes that are being dispensed by a next request.

SUMMARY

Embodiments provide an ice dispensing apparatus that can prevent damage or malfunction of the apparatus and improve reliability by dispensing a fixed amount of ice cubes (or ice pieces) and a refrigerator having the ice dispensing apparatus.

In an embodiment, an ice dispensing apparatus includes a case provided with an ice inlet and an ice outlet; a conveying unit that is provided on a first side of the case to convey and discharge ice cubes through the ice outlet; an ice-crushing unit that is provided on a second side of the case to crush the ice cubes into ice pieces and discharge the crushed ice pieces through the ice outlet; and an ice delivery unit for delivering the ice cubes input through an input portion to the conveying unit or the ice-crushing unit.

In another embodiment, an ice dispensing apparatus includes a case provided with an ice inlet and an ice outlet; a conveying unit that is provided on a first side of the case to convey and discharge ice cubes through the ice outlet; a guide member that is disposed at a second side of the case and connected to the conveying unit to guide the ice cubes in different directions in accordance with an ice mode; and an ice delivery/crushing unit located under the guide member, wherein the ice delivery/crushing unit delivers the ice cubes on the guide member to the conveying unit in a ice cube mode by partly passing through the guide member and contacting the ice cubes and delivers the ice cubes in a direction away from the conveying unit in an crushed ice mode to crush the ice cubes and discharges the crushed ice pieces by partly passing through the guide member and contacting the ice cubes.

In still another embodiment, a refrigerator includes a main body having a freezing compartment therein; a door opening and closing the freezing compartment; an ice making apparatus that is installed on one of the freezing compartment and the door; an ice dispensing apparatus for dispensing an proper amount of ice having a proper size; and a chute along which the ice discharged from the ice dispensing apparatus is discharged out of the door, wherein the ice dispensing apparatus includes a case provided with an ice inlet and an ice outlet; a conveying unit that is provided on a first side of the case to convey and discharge ice cubes through the ice outlet; an ice-crushing unit that is provided on a second side of the case to crush the ice cubes into ice pieces and discharge the crushed ice pieces through the ice outlet; and an ice delivery unit for delivering the ice cubes input through an input portion to the conveying unit in an ice cube mode or to the ice-crushing unit in a crushed ice piece mode.

According to the embodiments, since a path along which ice cubes are dispensed is completely different from a path along which crushed ice cubes are dispensed, a bottleneck phenomenon caused by remained ice can be prevented and thus damage or malfunction of the ice dispensing apparatus can be prevented, thereby improving reliability of the product.

DETAILED DESCRIPTION OF THE EMBODIMENTS

Reference will now be made in detail to the embodiments of the present disclosure, examples of which are illustrated in the accompanying drawings.

Figure 1:
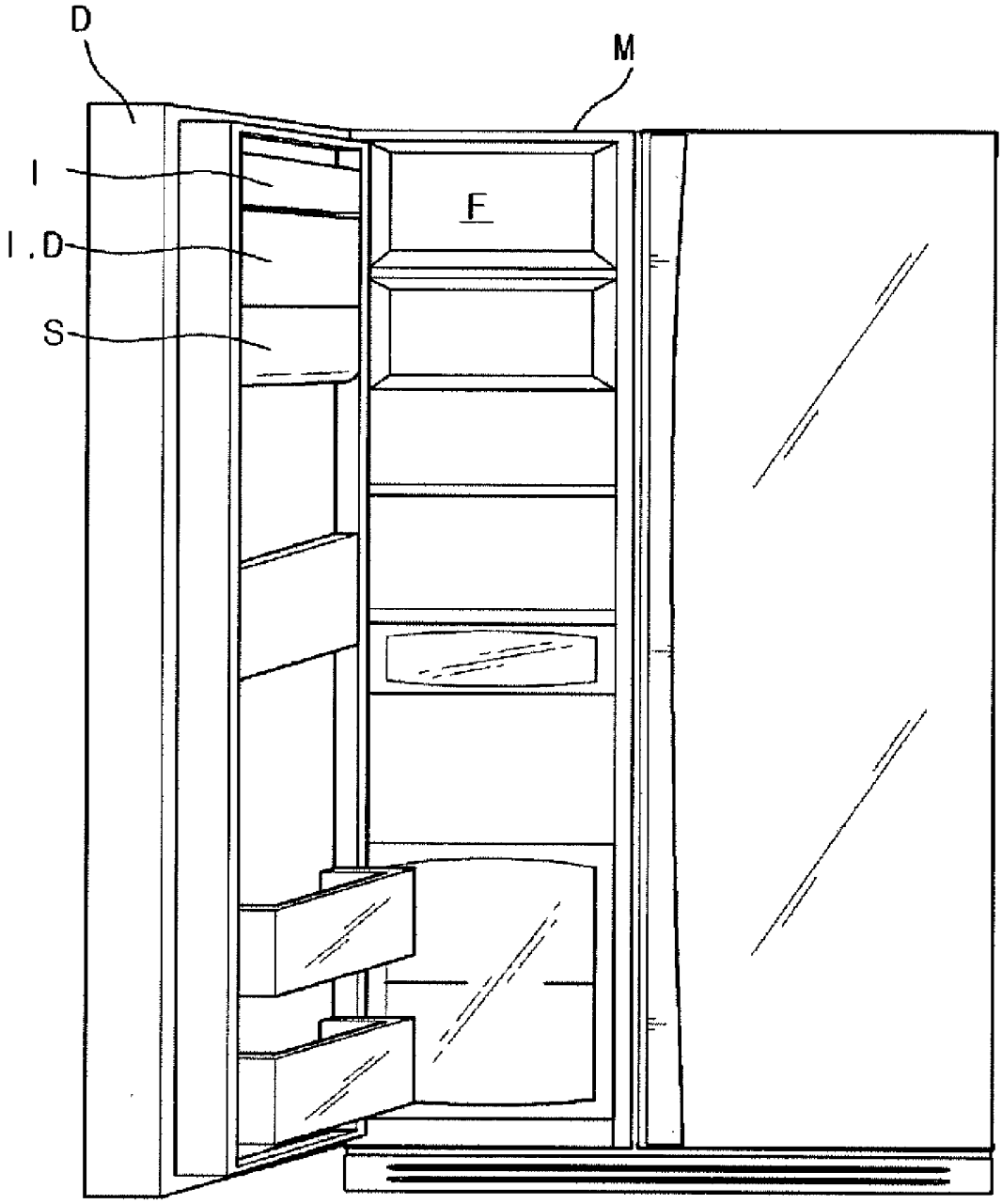
FIG. 1 is a perspective view of a refrigerator to which embodiments may be applied.

FIG. 1 is a perspective view of a refrigerator associated with following embodiments.

Referring to FIG. 1, a refrigerator of this embodiment includes a main body M, a freezing compartment provided in the main body M, a door D for opening and closing the freezing compartment F. The refrigerator further includes an ice making apparatus I for making ice and an ice dispensing apparatus I.D for dispensing the ice, which are installed on an inner wall of the door D or in the freezing compartment F.

The ice dispensing apparatus I.D and the ice making apparatus I must be designed to dispense the ice in a state where the door D is closed regardless of the installation location thereof.

Therefore, a chute along which the ice discharged from the ice dispensing apparatus I.D is discharged to an external side is installed to communicate with the external side.

Although the ice dispensing apparatus is applied to the refrigerator in this embodiment, the present disclosure is not limited to this embodiment. For example, the ice dispensing apparatus may be also applied to all of appliances such as a bending machine or a water purifying apparatus, which are designed to dispense the ice.

First Embodiment

Figure 2:
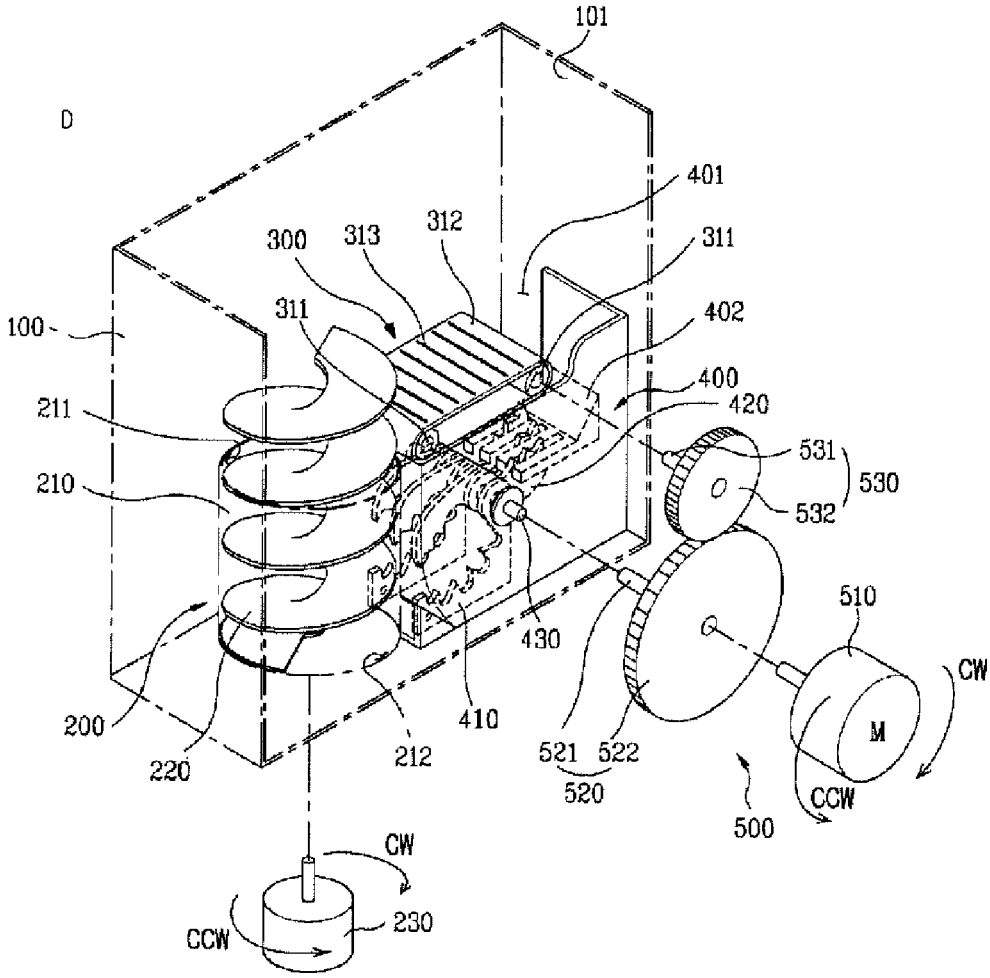
FIGS. 2 and 3 are respectively perspective and front views of an ice dispensing apparatus having a conveyer type ice delivery unit according to a first embodiment.
Figure 3:
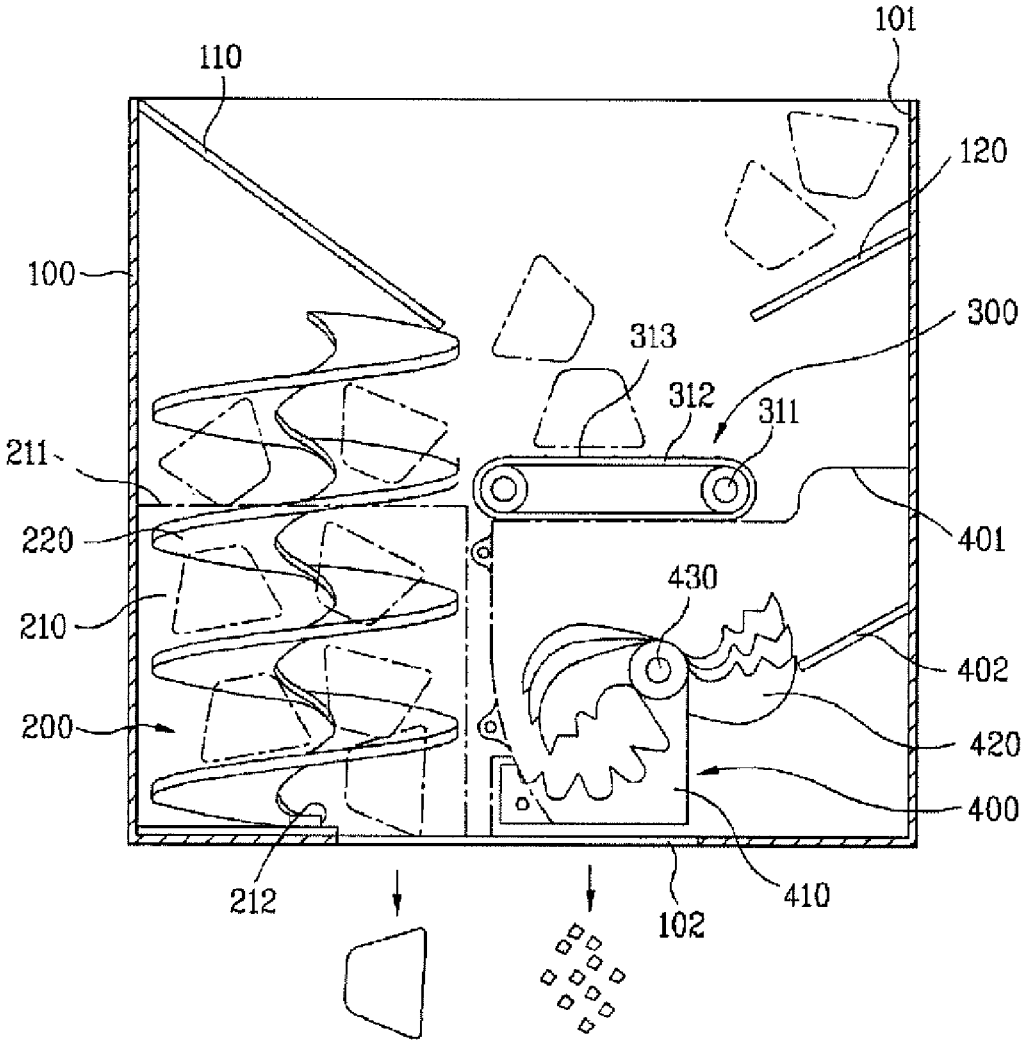

FIGS. 2 and 3 are respectively perspective and front views of an ice dispensing apparatus having a conveyer type ice delivery unit according to a first embodiment.

Referring to FIG. 2, an ice dispensing apparatus of this embodiment includes a case 10 defining a space for receiving ice cubes supplied from an ice making apparatus and having an ice inlet 101 and an ice outlet 102, a conveying unit 200 that is provided on a first side of an inside of the case 100 to discharge the ice cubes through the ice outlet 102, an ice-crushing unit 400 that crushes the ice cubes into ice pieces and discharges the ice pieces through the ice outlet 102, and an ice delivery unit 300 for delivering the ice cubes to the conveying unit 200 in an ice cube mode and to the ice-crushing unit 400 in an ice piece mode.

The ice-crushing unit 400 and the ice delivery unit 300 are driven by a driving unit 500. The driving unit 500 includes a driving motor 510, a driving gear set 520 rotating by the driving motor 510, and a driven gear set 530 that is engaged with the driving gear set 520 to receive rotational force of the driving motor 510 through the driving gear set 520.

The driving gear set 520 includes a driving gear 522 and a driving shaft 521 connected to the driving motor 510. The driving shaft 521 is connected to the ice-crushing unit 400 to transmit the rotational force of the driving motor 510 to the ice-crushing unit 400.

The driving gear 522 is engaged with a driven gear 532 of the driven gear set 530 to transmit the rotational force to the driven gear 532. The rotational force of the driven gear 532 is transmitted to a driven shaft 531 that is connected to a rotational shaft 311 of the ice delivering unit 300 to rotate the rotational shaft 311, thereby driving the ice delivering unit 300.

The ice delivery unit 300 includes a pair of rotational shafts 311 that are respectively provided at opposite ends thereof and a conveyer belt 312 disposed around the pair of the rotational shafts 311 and rotating by rotation of the rotational shafts 311. A plurality of conveying protrusions are formed on an outer circumference of the conveying belt 312 to prevent the ice from slipping during conveying. Although the conveyer is proposed as the ice delivery unit by way of example, the present disclosure is not limited to this embodiment.

The rotational shaft 311 rotates by the driven gear 530. At this point, in order to rotate the conveyer 300, there is no need to essentially rotate both of the rotational shafts 311. Therefore, as shown in FIG. 12, even when the driven gear 530 is connected to only one of the shafts 311, the ice delivery unit 300 can be driven. However, it is preferable to provide two driven gears 530 that are respectively connected to the rotational shafts 311. In this case, the operational reliability can be enhanced. In FIG. 2, only one driven gear is shown for the simplicity.

The conveying unit 200 includes a cylindrical body 210 provided adjacent to the ice delivery unit 300 and communicating with the ice outlet 102 of the case 100 and a spiral blade 220 that rotates to convey ice toward the ice outlet 102. In more detail, the cylindrical body 210 has an opened upper end to define an ice input portion 211 through which the ice is loaded in the cylindrical body 210 and an ice-discharging portion 212 communicating with the ice outlet 102 of the case 100. The spiral blade 220 extends up to the ice-discharging portion 212 and has a predetermined width. Even when the spiral blade 220 doe not rotate, the ice can be conveyed from the ice-loading portion 221 toward the ice-discharging portion 212 while slipping. In this case, the conveying, however, is not effectively realized. Therefore, in order to effectively convey the ice, it is preferable to rotate the spiral blade 220. In this embodiment, a driving unit 230 is provided to rotate the spiral blade 220 by way of example.

The driving unit 230 may be a motor having a shaft connected to a center of the spiral blade 220. Therefore, when the driving unit 230 is driven, the spiral blade 220 rotates.

The ice-crushing unit 400 includes a shaft 430 receiving the rotational force of the driving motor 510, a stationary blade 410 that is fixed not to rotate relatively to the shaft 430, a rotational blade 420 that is installed to rotate relatively to the shaft 430, thereby crushing the ice cubes delivered from the ice delivery unit 300 by the interaction with the stationary blade 410. The ice-crushing unit 400 is disposed under the ice delivery unit 300 at an opposite side to the conveying unit 200. The ice-crushing unit 400 includes an opening 401 through which the ice cubes delivered from the ice delivery unit 300 is input and a guide 402 directing the ice cubes input through the opening 401 to the rotational blade 420.

The ice dispensing apparatus will be described in more detail with reference to FIG. 3.

Referring to FIG. 3, the ice dispensing apparatus of this embodiment includes a first guide member 110 that is inclined from a first side of the inner wall of the case 100 toward the ice-delivery unit 300 at a predetermined angle to guide the ice cubes input through the ice inlet 101 toward the ice delivery unit 300 and a second guide member 120 that is inclined from a second side of the inner wall of the case 100 toward the ice delivery unit 300 at a predetermined angle to guide the ice cubes input through the ice inlet 101 to the ice delivery unit 300.

Only one of the first and second guide members 110 and 120 may be provided. That is, an ice input location is considered. For example, when there is no possibility that the ice cubes are input to the second guide member 120, there is no need to install the second guide member 120. It is, however, preferable that both of the first and second guide members 110 and 120 are installed to enhance the reliability of the product.

The following will describe operation of the ice dispensing apparatus of this embodiment with reference to FIGS. 2 and 3.

In an ice cube mode that is set by the user wanting the ice cubes, the ice cubes 100 is supplied from the ice making apparatus into the case 100 through the ice inlet 101. Needless to say, the ice cubes may be already accumulated in the case 100 by being supplied from the ice making apparatus. In this case, the driving motor 510 of the driving unit 500 rotates clockwise CW and thus the driving gear 522 rotates clockwise CW. In addition, the driven gear 532 rotates counterclockwise CCW.

Then, the driven shaft 531 also rotates counterclockwise CCW and thus the rotational shaft 311 connected to the driven shaft 531 also rotates counterclockwise. As a result, the ice cubes on the conveyer belt 312 is conveyed toward the conveying unit 200.

The ice cubes conveyed by the ice delivery unit 300 is directed into the cylindrical body 210 through the ice input portion 211. At this point, the driving unit 230 rotates clockwise CW to rotate the spiral blade 220 clockwise, thereby discharging the ice cubes out of the cylindrical body 210 through the ice-discharging portion 121 and subsequently discharged out of the case 100 through the ice outlet 102.

In an ice piece mode that is set by the user wanting crushed ice pieces, the driving motor 510 rotates counterclockwise to rotate the driving gear 522 counterclockwise and to rotate the driven gear 532 clockwise. Therefore, the rotational shaft 311 connected to driven shaft 531 rotates clockwise to convey the ice cubes on the conveyer belt 312 toward the opening 401. The ice cubes input through the opening 401 are guided to the rotational blade 420 by the guide portion 402. At this point, since the driving shaft 521 rotates counterclockwise, the shaft 430 rotates counterclockwise to rotate the rotational blade 420 counterclockwise. Then, as the rotational blade 420 rotates counterclockwise, the ice cubes 410 stop on the stationary blade 410. Subsequently, the ice cubes on the stationary blade 410 are crushed by force generated when the rotational blade 420 keep rotating counterclockwise. The crushed ice pieces are discharged through the ice outlet 102.

Second Embodiment

Many parts of a second embodiment are identical to those of the first embodiment. Therefore, description of the like parts will be omitted herein. Only different parts from the first embodiment will be described herein.

Figure 4:
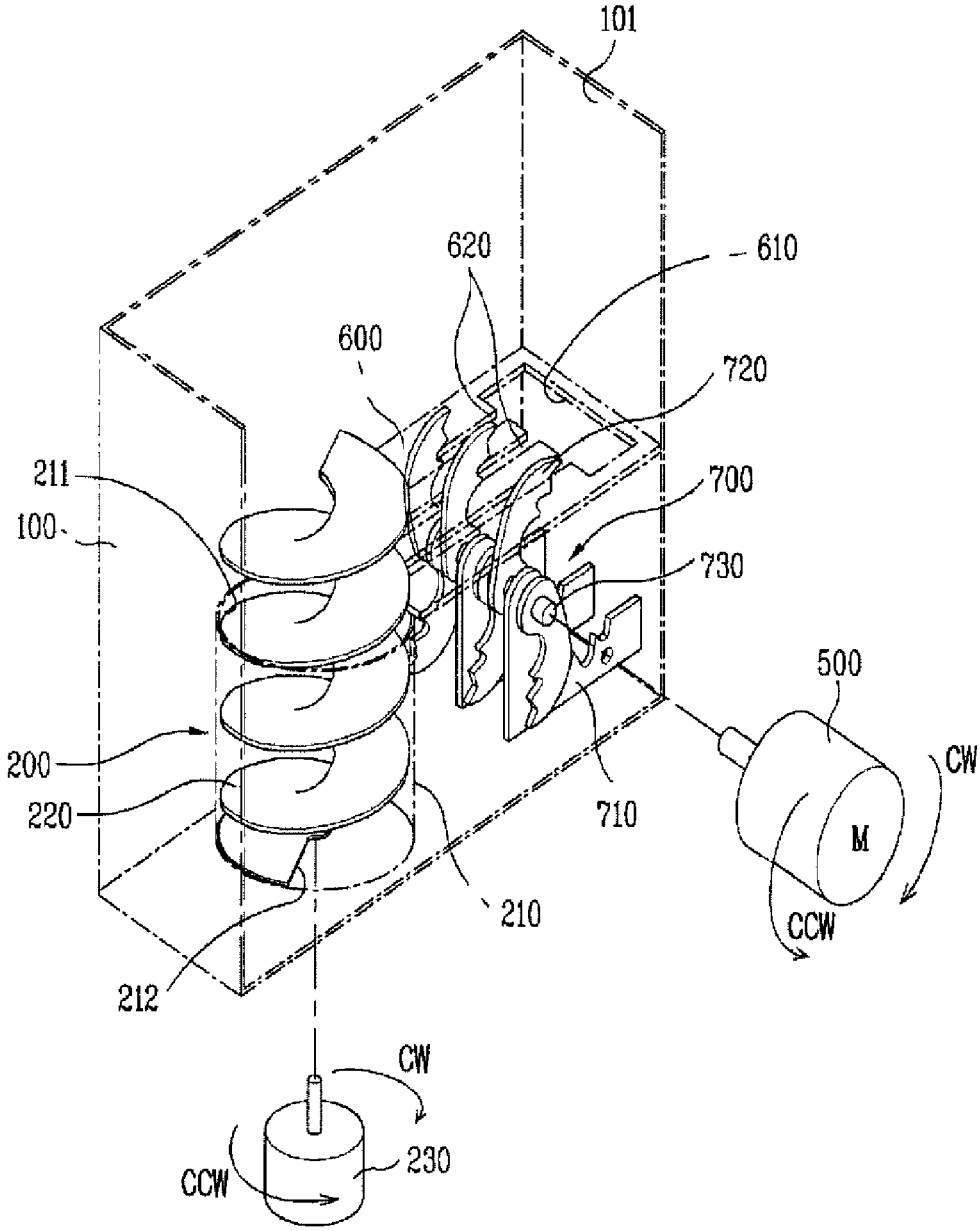
FIG. 4 is a perspective view of an ice dispensing apparatus according to a second embodiment.

FIG. 4 is a perspective view of an ice dispensing apparatus according to a second embodiment.

Referring to FIG. 4, an ice dispensing apparatus of this embodiment includes a case 100 defining a space for receiving ice cubes supplied from an ice making apparatus and having an ice inlet 101 and an ice outlet 102, a conveying unit 200 that is provided on a first side of an inside of the case 100 to discharge the ice cubes through the ice outlet 102, a guide member 600 that is disposed at a second side of the inside of the case 100 and connected to the conveying unit 200 to guide the ice cubes in different directions in accordance with an ice mode, and an ice delivery/crushing unit 700 located under the guide member 600.

The ice dispensing apparatus further includes a driving unit 500 for rotating the ice delivery/crushing unit 700 clockwise or counterclockwise.

The ice delivery/crushing unit 700 includes a shaft 730 that is connected to the driving unit 500 to rotate by the driving unit 500, a stationary blade 710 that is fixed to the shaft 730 not to rotate, and a rotational blade 720 that is rotatably coupled to the shaft 730.

The guide member 600 is disposed within a radius of gyration. That is, the guide member 600 is installed such that a distance from the shaft 730 of the ice delivery/crushing unit 700 to an end of the rotational blade 72 is less than a distance from the shaft 730 to the guide member 600.

The guide member 600 is provided with guide slots 620 so that the rotational blade 720 protrudes above the guide member 600 through the guide slots 620. Therefore, the rotational blade 720 rotates clockwise or counterclockwise by the driving unit 500. At this point, the protruding portion of the rotational blade 720 above the guide member 600 pushes the ice cubes to the conveying unit 200 or toward an input hole 610 formed on the guide member 600. The ice cubes are input through the input hole 610 and located on the stationary blade 710.

Although not shown in FIG. 4, the ice outlet 102 of the case 100 is formed on a bottom of the case 100 to communicate with an ice-discharging portion 212 of the conveying unit 200. An ice outlet formed under the stationary blade 710 different from the ice outlet of the ice-discharging portion 212 also. However, an ice outlet under the ice-discharging portion 212 may be same with an ice outlet under the stationary blade 710 as a only one ice outlet. In any cases, it may be noted that a location through which the ice is discharged from the ice-discharging portion 212 of the conveying unit 200 is different from a location through which the ice is discharged from the stationary blade.

The following will describe operation of the ice dispensing apparatus of this embodiment with reference to FIG. 4.

In an ice cube mode, the ice cubes input through the ice inlet 101 are disposed on the guide member 600 and the driving unit 500 rotates counterclockwise to rotate the rotational blade 720 counterclockwise.

At this point, the rotational blade 720 rotates passing through the guide slots 620 of the guide member 600 to push the ice cubes on the guide member 600 toward the conveying unit 200. The ice cubes pushed by the rotational blade 720 is supplied into the cylindrical body 210 through the input portion 211 and directed to the ice-discharging portion 212 along the spiral blade 220 and subsequently discharged through the ice outlet. At this point, the driving unit 230 rotates clockwise to convey the ice cubes on the spiral blade 220 to the ice-discharging portion 212.

Meanwhile, in an ice piece mode, the ice cubes input through the ice inlet 101 are disposed on the guide member 600 and the driving unit 500 rotates clockwise CW to rotate the rotational blade 720 clockwise. At this point, the rotational blade 720 rotates passing through the guide slots 620 of the guide member 600 to push the ice cubes on the guide member 600 to the input hole 610.

The ice cubes pushed by the rotational blade 720 are disposed on the stationary blade 710, crushed by the rotational blade 720 rotating clockwise, and discharged out of the case.

According to this second embodiment, unlike the first embodiment where the ice delivery unit and the ice-crushing unit are separated, the ice delivery unit and the ice-crushing unit are integrated as a single member. Therefore, the structure of the apparatus can be simplified to lower the manufacturing costs.

Third Embodiment

Figure 5:
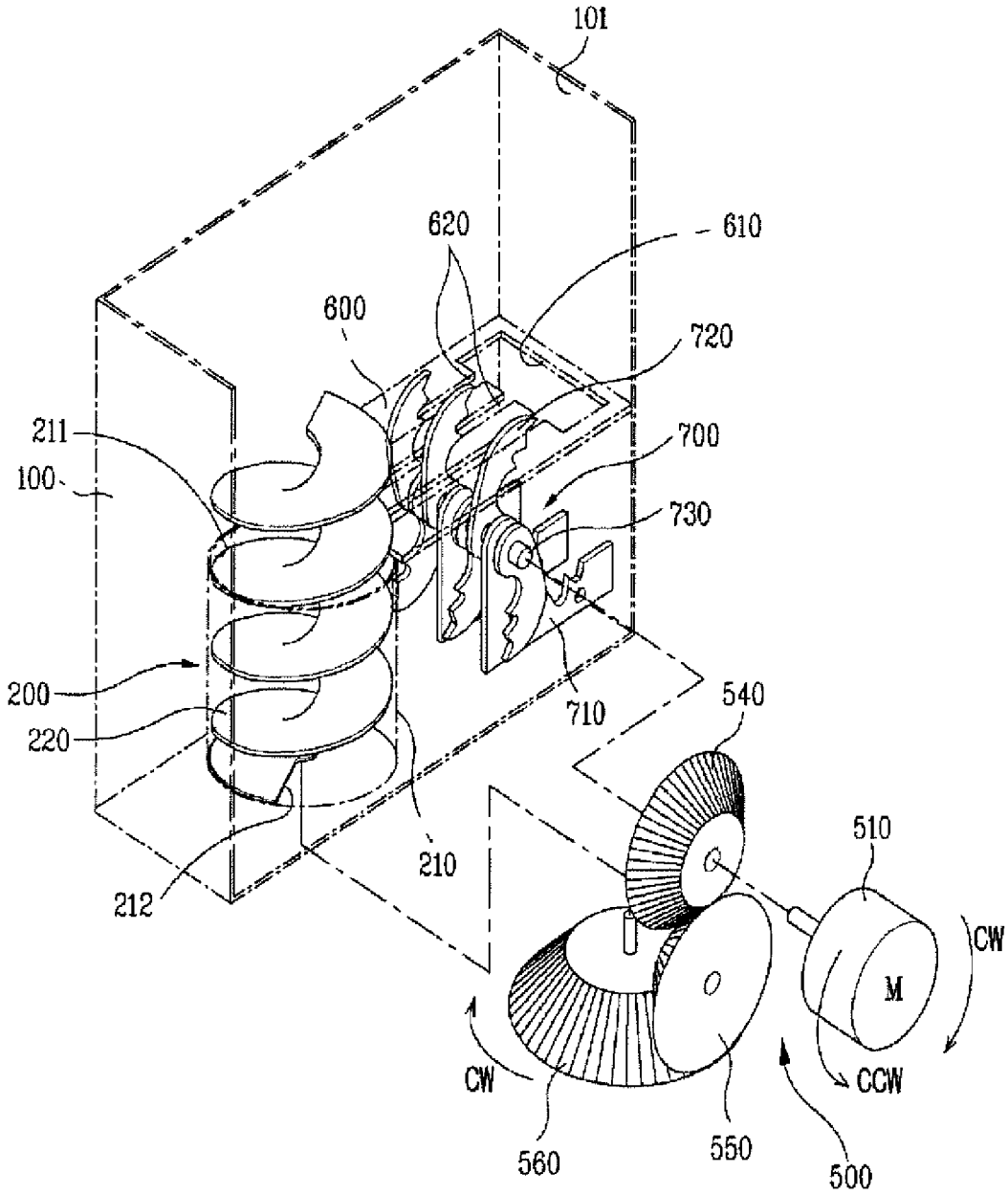
FIG. 5 is a perspective view of an ice dispensing apparatus according to a third embodiment.

FIG. 5 is a perspective view of an ice dispensing apparatus according to a third embodiment.

Referring to FIG. 5, a third embodiment is same as the first and second embodiments except for a structure of the driving unit. In FIG. 5, an internal structure of the case is illustrated to be identical to that of the second embodiment by way of example. However, it should be noted that a feature of this third embodiment can also be associated with an internal structure of the first embodiment.

According to a feature of this embodiment, a driving unit for driving the conveying unit 200 is not independently provided. That is, the conveying unit 200 is driven by a driving unit 500 for driving the ice delivery/crushing unit (or the ice delivery unit and ice-crushing unit in the first embodiment. In more detail, the driving unit 500 is designed to simultaneously drive the conveying unit 200 and the ice delivery/crushing unit.

The driving unit 500 includes a driving motor 510, a driving bevel gear set driven by the driving motor 510, and a driven bevel gear set geometrically perpendicular to and engaged with the driving bevel gear set.

The driving bevel gear set includes a driving bevel gear 540 that is connected to the driving motor 510 to rotate by the driving motor 510 and a driven bevel gear 660 rotatably engaged with the driving bevel gear 540. The driven bevel gear 550 may be omitted if not necessary.

The driven bevel gear set includes a driven bevel gear 560 that is perpendicular to and engaged with the driven bevel gear 550 and has a rotational shaft that is aligned with and connected to a rotational axis of the spiral blade 220 to rotate the spiral blade 220. The driven bevel gear 560 may further includes another driven bevel gear or another connecting member such as a belt if necessary.

The following will describe operation of the ice dispensing apparatus of this third embodiment.

In an ice cube mode, the driving motor 510 rotates clockwise CW to rotate the driving bevel gear 540 clockwise. As a result, the shaft 730 rotates clockwise and the rotational blade 720 rotates clockwise.

The rotational blade 720 rotates passing through the guide slots 620 clockwise to input the ice cubes through the input hole 610. The ice cubes input through the input hole 610 are disposed on the stationary blade 710 and crushed by the rotational blade 720 rotating clockwise.

In a crushed ice piece mode, the driving motor 510 rotates counterclockwise to rotate the driving bevel gear 540 counterclockwise and to rotate the driven bevel gear 550 clockwise. The driven bevel gear 560 engaged with the driven bevel gear 550 rotates clockwise CW to rotate the spiral blade 220 clockwise.

At this point, the rotational blade 720 rotates passing through the guide slots 620 to push the ice cubes disposed on the guide member 600 toward the conveying unit. The ice cubes are introduced into the cylindrical body 210 through the ice input portion 211 and directed to the ice-discharging portion 212 along the spiral blade 220, after which the ice cubes are discharged out of the case.

The above-described operation may be similarly applied to a case where the feature of this third embodiment is associated with the internal structure of the first embodiment. However, one or more bevels gears are added to properly adjust the rotational directions of the components.

According to the present disclosure, a fixed amount of ice can be dispensed. In addition, an ice dispensing path in the ice cube mode is completely different from an ice dispensing path in the ice piece mode, thereby preventing the apparatus from be damaged or malfunctions and thus improving the reliability of the product.

What is claimed is:

1. An ice dispensing apparatus, comprising:

a case provided with an ice inlet and an ice outlet;

a conveying unit that is provided on a first side of the case to convey and discharge ice cubes through the ice outlet;

an ice-crushing unit that is provided on a second side of the case to crush the ice cubes into ice pieces and discharge the crushed ice pieces through the ice outlet, the ice-crushing unit including a rotational blade that is rotatably coupled to a shaft; and a guide member disposed at the second side of the case and configured to guide the ice cubes in different directions in accordance with an ice mode, the guide member having a slot and being positioned so that at least a portion of the rotational blade of the ice-crushing unit passes by the guide member through the slot, wherein the rotational blade is rotated in a first direction to push the ice cubes toward the first side of the case when the ice dispensing apparatus is in an ice cube dispensing mode of operation, and wherein the rotational blade is rotated in a second direction to push the ice cubes toward the second side of the case when the ice dispensing apparatus is in a crushed ice dispensing mode of operation.

2. The ice dispensing apparatus according to claim 1, further comprising a driving unit comprising:

a driving motor for driving the ice-crushing unit;

a driving gear rotating by the driving motor; and a driven gear that is engaged with the driving gear to drive the ice-crushing unit.

3. The ice dispensing apparatus according to claim 1, wherein the conveying unit comprises:

a cylindrical body disposed adjacent to the guide member and communicating with the ice outlet; and a spiral blade disposed in the cylindrical body.

4. The ice dispensing apparatus according to claim 1, wherein the conveying unit and the ice-crushing unit are driven by a common driving unit.

5. The ice dispensing apparatus according to claim 1, wherein the ice-crushing unit comprises:

a stationary blade fixed with reference to the case; and wherein the rotational blade is configured to crush the ice cubes disposed on the stationary blade, wherein the ice cubes are directed to the stationary blade or the conveying unit by adjusting a rotational direction of the rotational blade.

6. The ice dispensing apparatus according to claim 1, wherein the ice-crushing unit further comprises a stationary blade that is fixed to the shaft and does not rotate, and wherein the guide member comprises an input hole so that the ice cubes are input through the input hole and guided toward the stationary blade.

7. An ice dispensing apparatus, comprising:

a case provided with an ice inlet and an ice outlet;

a conveying unit that is provided on a first side of the case to convey and discharge ice cubes through the ice outlet;

a guide member that is disposed at a second side of the case and connected to the conveying unit to guide the ice cubes in different directions in accordance with an ice mode; and an ice delivery and crushing unit located under the guide member, wherein the ice delivery and crushing unit delivers the ice cubes on the guide member to the conveying unit in an ice cube mode by partly passing through the guide member and contacting the ice cubes and delivers the ice cubes in a direction away from the conveying unit in a crushed ice mode to crush the ice cubes and discharges the crushed ice pieces by partly passing through the guide member and contacting the ice cubes.

8. The ice dispensing apparatus according to claim 7, further comprising a driving unit for selectively rotating the ice delivery and crushing unit clockwise or counterclockwise.

9. The ice dispensing apparatus according to claim 7, wherein the ice delivery and crushing unit comprises:

a rotational blade that partly protrudes above the guide member; and a stationary blade fixed relative to the case.

10. The ice dispensing apparatus according to claim 7, wherein the guide member is provided with an input hole through which the ice cubes are directed to the ice delivery and crushing unit in a crushed ice piece mode.

11. The ice dispensing apparatus according to claim 7, wherein the conveying unit comprises:

a cylindrical body provided adjacent to the ice delivery and crushing unit and communicating with the ice outlet of the case; and a spiral blade disposed in the cylindrical body.

12. The ice dispensing apparatus according to claim 11, wherein the common driving unit comprises:

a driving motor rotating clockwise and counterclockwise;

a driving bevel gear set rotating by the driving motor; and a driven bevel gear set that is substantially perpendicular to the driving bevel gear and rotates by the driving bevel gear set to rotate the spiral blade.

13. The ice dispensing apparatus according to claim 7, wherein the conveying unit and the ice delivery and crushing unit are driven by a common driving unit or respective driving units.

14. The ice dispensing apparatus according to claim 7, wherein the conveying unit conveys the ice cubes in a gravity direction.

15. A refrigerator comprising:

a main body having a freezing compartment therein;

a door opening and closing the freezing compartment;

an ice making apparatus that is installed on one of the freezing compartment and the door;

an ice dispensing apparatus for dispensing a proper amount of ice having a proper size; and a chute along which the ice discharged from the ice dispensing apparatus is discharged out of the door, wherein the ice dispensing apparatus comprises:

a case provided with an ice inlet and an ice outlet;

a conveying unit that is provided on a first side of the case to convey and discharge ice cubes through the ice outlet;

an ice-crushing unit that is provided on a second side of the case to crush the ice cubes into ice pieces and discharge the crushed ice pieces through the ice outlet, the ice-crushing unit including a rotational blade that is rotatably coupled to a shaft; and a guide member disposed at the second side of the case and configured to guide the ice cubes in different directions in accordance with an ice mode, the guide member having a slot and being positioned so that at least a portion of the rotational blade of the ice-crushing unit passes by the guide member through the slot, wherein the rotational blade is rotated in a first direction to push the ice cubes toward the first side of the case when the ice dispensing apparatus is in an ice cube dispensing mode of operation, and wherein the rotational blade is rotated in a second direction to push the ice cubes toward the second side of the case when the ice dispensing apparatus is in a crushed ice dispensing mode of operation.

16. The refrigerator according to claim 15, wherein the ice-crushing unit further comprises a stationary blade that is fixed to the shaft and does not rotate, and wherein the guide member comprises an input hole so that the ice cubes are input through the input hole and guided toward the stationary blade.

17. The refrigerator according to claim 15, wherein the conveying unit comprises:

a cylindrical body disposed adjacent to the guide member and communicating with the ice outlet; and a spiral blade disposed in the cylindrical body.

18. The refrigerator according to claim 15, wherein the conveying unit and the ice-crushing unit are driven by a common driving unit.

* * * * *